US009279428B2

(12) United States Patent
Lowe et al.

(10) Patent No.: US 9,279,428 B2
(45) **Date of Patent: *Mar. 8, 2016**

(54) QUICK INSTALLATION CEILING FAN BLADES

(71) Applicant: Chien Luen Industries Co., Ltd., Inc., Oakland Park, FL (US)

(72) Inventors: Tien S Lowe, Cooper City, FL (US); Mark Veltuni, Alpharetta, GA (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/500,945

(22) Filed: Sep. 29, 2014

(65) Prior Publication Data

US 2015/0078903 A1 Mar. 19, 2015

Related U.S. Application Data

(62) Division of application No. 13/204,310, filed on Aug. 5, 2011, now Pat. No. 8,845,293.

(51) Int. Cl.

| | |
|---|---|
| ***F04D 29/34*** | (2006.01) |
| ***F04D 25/08*** | (2006.01) |
| ***F04D 29/64*** | (2006.01) |

(52) U.S. Cl.

CPC ..... *F04D 29/34* (2013.01); *F04D 25/088* (2013.01); *F04D 29/644* (2013.01); *F05D 2230/60* (2013.01); *Y10T 29/49327* (2015.01)

(58) Field of Classification Search

CPC ..... F04D 25/088; F04D 29/263; F04D 29/34; F04D 29/644; F05D 2230/60

USPC ..... 416/5, 131, 135, 194, 204 R, 210 R, 205, 416/206; D23/411, 413

See application file for complete search history.

(56) References Cited

U.S. PATENT DOCUMENTS

| | | | |
|---|---|---|---|
| 4,175,622 | A | 11/1979 | Summerfelt |
| 4,936,751 | A | 6/1990 | Marshall |
| 6,010,306 | A | 1/2000 | Bucher |
| 6,171,059 | B1 | 1/2001 | Bucher |
| 6,213,716 | B1 | 4/2001 | Bucher |

(Continued)

*Primary Examiner* — Ninh H Nguyen

(74) *Attorney, Agent, or Firm* — Brian S. Steinberger; Law Offices of Brian S. Steinberger, P.A.

(57) ABSTRACT

Devices, apparatus, systems, and methods for the quick installation of ceiling fan blades for ceiling fans. The invention uses a blade with three slots running in a linear direction from the mounting end of the blade, and three pre-attached fasteners upwardly projecting from the outer end of a blade arm. One of the fasteners is springably bendable with inwardly extending clip edge, another fastener that forms an upright post, and a third fastener having a top end with an outwardly extending lip edge. Another embodiment can include four slots per blade and four pre-attached upwardly protruding fasteners per blade arm. A novel method of installing each blade can include angling the blade to the mounting ends of the blade arm so that the outwardly extending lip edge catches on the third slot in from the mounting end of the blade. Next, the blade is laid down so that the other two slot openings pass over the other pre-attached fasteners while moving the mounting end of the blade toward the motor mounting end of the blade arm. This causes the springably bendable fastener to bend back and snapably spring back catching onto the first slot locking the blade to the blade arm.

20 Claims, 18 Drawing Sheets

(56) References Cited

U.S. PATENT DOCUMENTS

| | | | |
|---|---|---|---|
| 6,352,407 | B2 | 3/2002 | Hill |
| 6,352,411 | B1 | 3/2002 | Bucher |
| 6,371,729 | B1 | 4/2002 | Tseng |
| 6,666,652 | B2 | 12/2003 | Bucher |
| 6,669,446 | B2 | 12/2003 | Hodgkins |
| 6,676,376 | B2 | 1/2004 | Kerr |
| 6,688,850 | B2 | 2/2004 | Bucher |
| 6,726,453 | B1 | 4/2004 | Hsieh |
| 6,902,375 | B2 | 6/2005 | Bird |
| 6,932,576 | B2 | 8/2005 | Bird |
| 6,935,842 | B2 | 8/2005 | Tai |
| 7,527,478 | B2 | 5/2009 | Pearce |
| 7,762,782 | B2 | 7/2010 | Wang |
| 7,771,172 | B2 | 8/2010 | Wang |
| RE43,629 | E | 9/2012 | Wu |

QUICK INSTALLATION CEILING FAN BLADES

This application is a Divisional Application of U.S. patent application Ser. No. 13/204,310 filed Sep. 30, 2010, now allowed as U.S. Pat. No. 8,845,293 issued Sep. 30, 2014, which is incorporated by reference in its' entirety.

FIELD OF INVENTION

This invention relates to ceiling fans, in particular to devices, apparatus, systems, and methods for the quick installation of ceiling fan blades for ceiling fans.

BACKGROUND AND PRIOR ART

Many ceiling fans primarily require the blades must be attached to the motor housing bracket arms by tightening multiple screws and the like. With most ceiling fans having up to five blades and each blade requiring three or more screws, the number of screw tightening operations can result in the installer having to separately screw approximately 15 screws or more per ceiling fan installation. Installing more than one fan in a home or building further compounds this installation problem.

Often these screws can become lost during the assembly operation. Rotating screws into the blades and blade arms of a ceiling mounted motor is not only difficult to accomplish, but results in most ceiling fans in the market place having visible screws that are unsightly. Furthermore, the underside location of these fastener screws detract from the appearance of the ceiling fan itself.

Installing more than one fan in a home or building further compounds this installation problem.

Another problem with using multiple loose screws occurs from the ceiling fans being run under continuous vibration conditions where the screws can loosen causing the blades to be accidentally released and result in damage to surrounding property and people in the vicinity.

An additional problem comes from ceiling fan blades needing to be cleaned to remove dirt and dust buildup. Current techniques have relied on manually holding brushes to the blades themselves which inherently tires the muscles in the cleaner's neck, shoulders, arms and hands. This messy cleaning with brushes causes the dirt to fall on both the cleaner and furniture and flooring below the fan. Having to remove blades by unscrewing multiple screws over one's head would also not be practical.

Attempts have been made at changing the attachment methods for the blades but still fail to overcome all the problems presented above. U.S. Pat. No. 4,884,947 to Rezek describes a cover for covering the blade to motor connections but still uses screw fasteners that have the problems described above. U.S. Pat. No. 5,180,284 to Monrose III et al. is entitled a "Detachable Blades for Ceiling Fans" and U.S. Pat. No. 5,433,585 to Yan has a removable pin connection for ceiling fan blades, but each of these patents still requires screw on brackets for both the motor housing and the blades.

U.S. Pat. No. 4,396,352 to Pearce and U.S. Pat. No. 5,520,515 to Bailey et al. describe pitch adjustment attachments for ceiling fans but also still require screw on brackets between both the motor housing and the attached blades. A still further problem of many of these detachable ceiling fan type blades is that natural centrifugal forces of the spinning fans increase the chances of dislodging the blades.

The assignee of this invention created the popular QUICK CONNECT® ceiling fan blade systems, where the installer used blades and blade arms, or blade arms and rotors where enlarged headed fasteners fit into wide portions of key hole type slots where the enlarged headed fasteners and keyhole slots were slid together so that the fasteners would be locked in place; and other types of fast assembly ceiling fan systems. See for example, U.S. Pat. Nos. 6,010,306; 6,171,059; 6,336,792; 6,352,411; 6,666,652; 6,802,694; 6,872,053; 7,281,899; 7,396,210; 7,766,622; 7,857,592; and 7,927,076.

However, the subject inventors have now discovered other techniques for the quick installation of ceiling fans that also do not require multiple loose screws and the like, to attach the blades to the ceiling fan arms.

SUMMARY OF THE INVENTION

A primary objective of the present invention is to provide devices, apparatus, systems, and methods for the quick installation of detachable blades for ceiling fans that are easy and quick to install.

A secondary objective of the present invention is to provide devices, apparatus, systems, and methods for the quick installation of detachable blades for ceiling fans that allow each blade to be locked in place to a blade arm.

A third objective of the present invention is to provide devices, apparatus, systems, and methods for the quick installation of detachable blades for ceiling fans that allow each blade to be locked in place to a motor housing.

A fourth objective of the present invention is to provide devices, apparatus, systems, and methods for the quick installation of detachable blades for ceiling fans that are adaptable to standard ceiling fan blades.

A fifth objective of the present invention is to provide devices, apparatus, systems, and methods for the quick installation of detachable blades for ceiling fans wherein the centrifugal force of the fans actually locks the blades in place.

A sixth objective of the present invention is to provide devices, apparatus, systems, and methods for the quick installation of detachable blades for ceiling fans where the blade arm connection does not show screw heads from beneath the fan.

A seventh objective of the present invention is to provide devices, apparatus, systems, and methods for the quick installation of detachable blades for ceiling fans wherein no removable fasteners such as screws are used to hold the blade to the fan.

An eighth objective of the present invention is to provide devices, apparatus, systems, and methods for the quick installation of detachable blades for ceiling fans having spring fastener to snapably lock the blades in place.

A quick installation ceiling fan can include a plurality of blades each of the blades having a plurality of slots adjacent to one end, and a plurality of blade arms, each of the blade arms having at least one upwardly extending pre-fixed fastener and a movably bendable fastener, wherein the blades are mounted to the blade arms by overlaying the slots over the pre-fixed fastener and the movably bendable fastener until the at least one upwardly extending pre-fixed fastener hooks onto one of the slots, and the moveably bendable fastener snaps onto another one of the slots.

The plurality of slots in each of the blades can include three slots per blade. The at least one upwardly extending pre-fixed fastener can include a first pre-fixed fastener has an enlarged head for clipping about an edge of the one of the slots, and a second pre-fixed fastener is a mounting post.

The moveably bendable fastener can include an enlarged head with a sloped upper surface on top of shaft wherein pushing down on the sloped top allows the fastener to bend until the enlarged head passes through the another of the slots and snaps back in place locking the moveable fastener to the another of the slots. The moveably bendable fastener can include an inwardly directed overhanging clip edge protruding in the direction of the motor mount end of the blade arm. The first pre-fixed fastener with the enlarged head can include an outwardly protruding clip ledge which extends to an outer end of the blade. The enlarged head can include a gripable surface.

Each blade arm can include at least one grommet adjacent to the plurality of slots for reducing vibration and undesirable noise from the blades being attached to the blade arms.

The plurality of slots in the each of the blade can include four slots per blade. The at least one upwardly extending pre-fixed fastener can include a pre-fixed fastener has an enlarged head for clipping about an edge of the one of the slots, and two pre-fixed fasteners which function as a mounting posts for two of the four slots. The moveably bendable fastener can include an enlarged head with a sloped upper surface on top of shaft wherein pushing down on the sloped top allows the fastener to bend until the enlarged head passes through the another of the slots and snaps back in place locking the moveable fastener to the another of the slots. The moveably bendable fastener can include an inwardly directed overhanging clip edge. The enlarged head on the pre-fixed fastener can include an outwardly protruding clip ledge which extends to an outer end of the blade.

A method of installing ceiling fan blades on a ceiling fan can include the steps of providing a plurality of blades each having mounting ends with a plurality of slots, providing a plurality of ceiling fan blade arms each having motor mounting ends and blade mounting ends with a plurality of upwardly protruding fasteners, with one of the fasteners being bendable, angling the blades to the mounting ends of the blade arms so that at least one of the fasteners passes through one of the slots, laying down the mounting ends of the blades over fasteners while moving the mounting ends of the blades toward the motor mounting ends of the blade arms while bending the bendable fastener, and locking the blades to the blade arms when the bendable fastener is bent back to snap in place into one of the slots.

The plurality of slots on each blade can include three slots per blade, and the plurality of upwardly protruding fasteners on each blade arm can include three pre-attached fasteners for each blade arm.

The plurality of slots on each blade can include four slots per blade, and the plurality of upwardly protruding fasteners on each blade arm can include four pre-attached fasteners for each blade arm.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
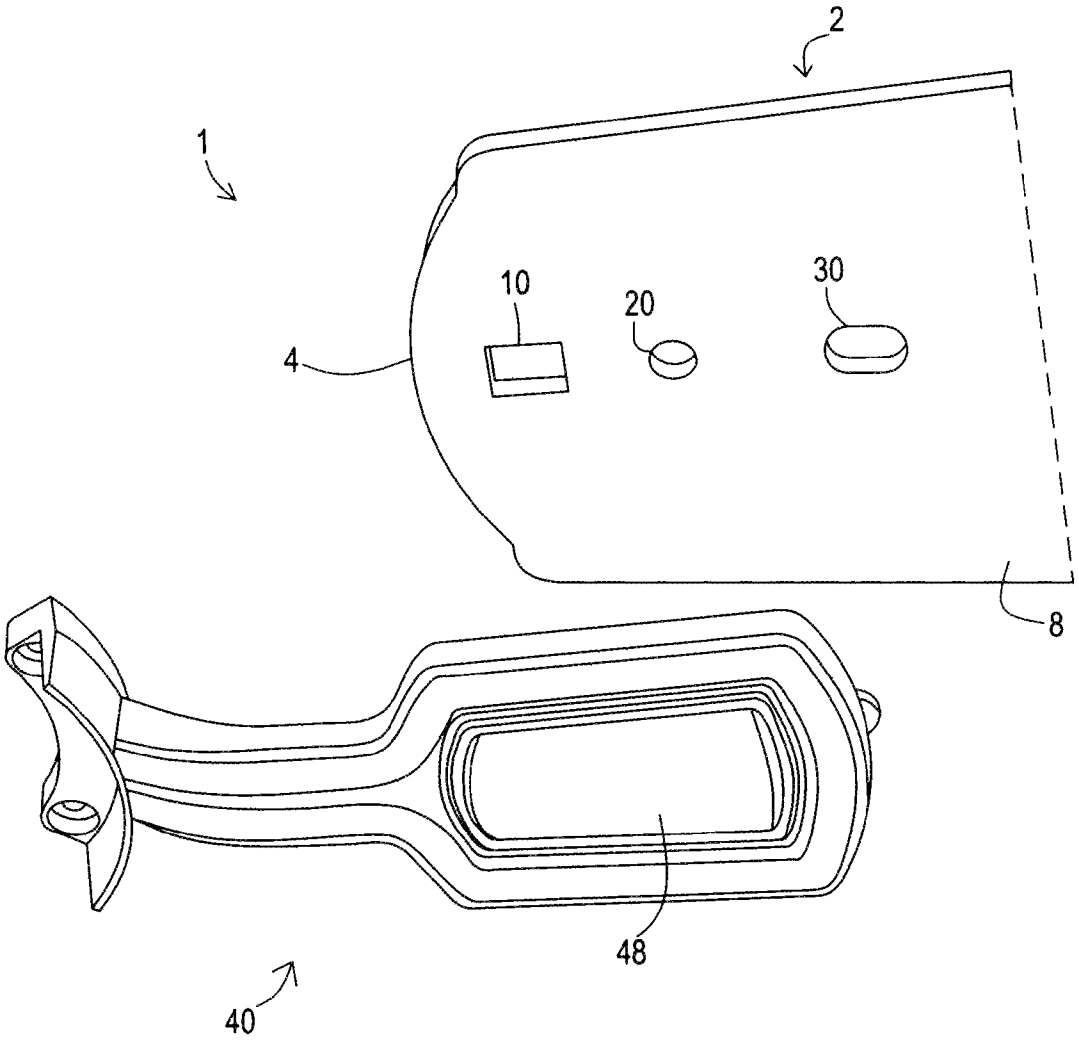
FIG. 1 is a bottom perspective view of a first embodiment of the quick installation ceiling fan blade spaced apart from a ceiling fan blade arm.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of components will now be described.

1. Three slot attachment embodiment
2. blade
4. mounting end of blade
6. top of blade
8. bottom of blade
10. spring catch slot
20. central slot
30. hook catch slot
40. blade arm
42. motor mounting end
44. blade mounting end
46. top of blade arm
48. bottom of blade arm
50. spring clip fastener
51. elongated base 51
52. inner end 52
53. pre-attached fixed fasteners such as screws
54. upwardly protruding bendable portion
55. generally sloped top with gripable (patterned, roughened) surface
56. inwardly extending overhanging clip edge
57. distal end
58. through-hole
59. pre-attached fixed enlarged headed fastener
60. central fastener

Figure 2:
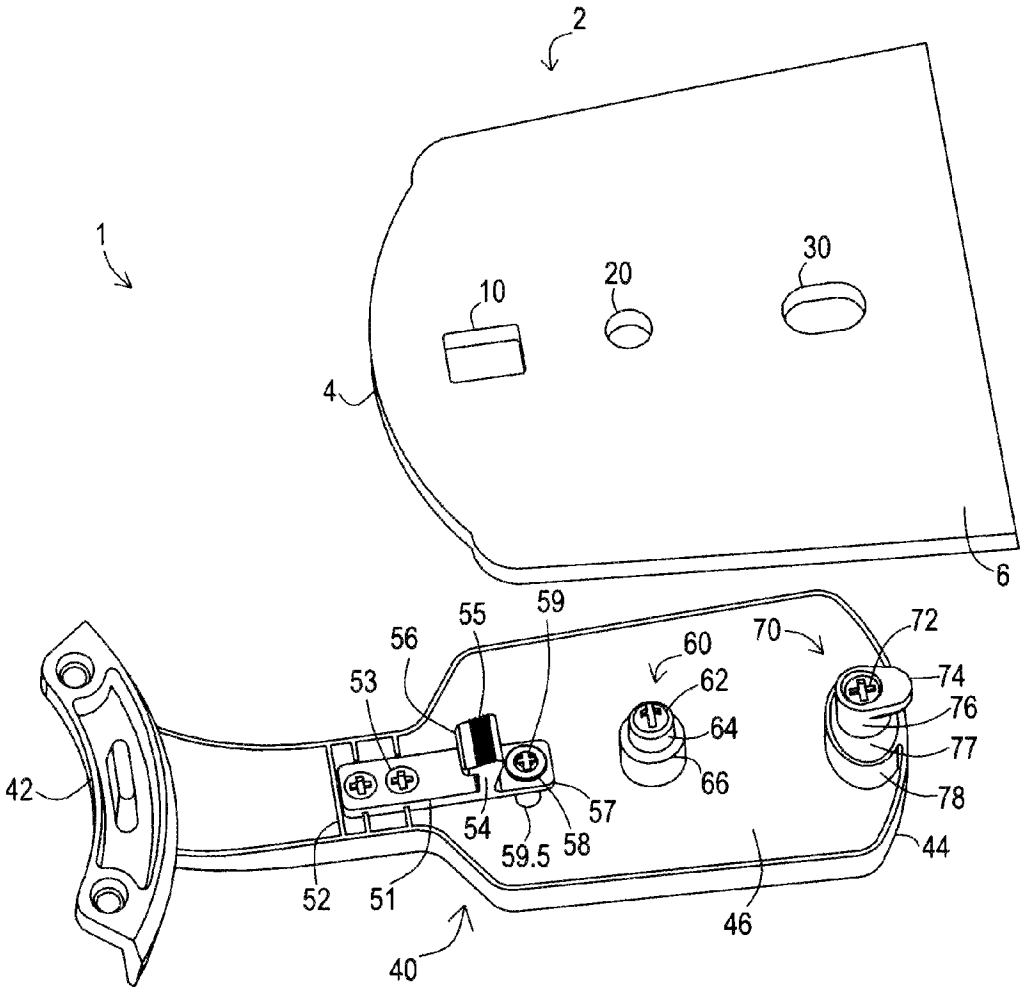
FIG. 2 is a top perspective view of the ceiling fan blade and blade arm of FIG. 1.

62. enlarged headed
64. one or more cylindrical washers
66. raised enlarged cylindrical base
70. hook fastener
72. a fastener 72
74. outwardly protruding clip ledge 74
76. shaft 76
77. outwardly sloping lower sides
78. enlarged base
100. Four slot attachment embodiment
20A. first central slot
20B. second central slot
60A. first central fastener
62A. first enlarged headed
64A. first set of one or more cylindrical washers
66B. second raised enlarged cylindrical base
60B. second central fastener
62B. second enlarged headed
64B. second set of one or more cylindrical washers
66B. second raised enlarged cylindrical base Three Slot Attachment FIG. 1 is a bottom perspective view of the quick installation three slot embodiment 1 with a bottom 8 of a ceiling fan blade 2 spaced apart from a ceiling fan blade arm 40. FIG. 2 is a top perspective view of the top of a ceiling fan blade 2 and blade arm 40 of FIG. 1. The blade 2 can be a standard type ceiling fan blade of any size having a mounting end 4 that is attached to a blade arm 40. The blade 2 can have three slots 10, 20 and 30 to allow for the quick attachment of the blade 2 to the outer end of the blade arm 40. The first slot 10 can have a rectangular configuration that passes through the blade 2. The second slot 20 can have a circular configuration that passes through the blade 2. The third slot 30 can have an oval configuration that passes through the blade 2.

The blade arm 40 can be any type of blade arm that can be used with a ceiling fan. This blade arm 40 can have an inner end 42 that attaches the blade arm 40 to a standard ceiling fan motor housing (not shown) and an outer end 44 on which a mounting end 4 of a blade 2 can attach thereto. The bottom 48 of the blade arm 40 can have a design that is visible from beneath a hung ceiling fan. The top 46 of the blade arm 40 has the pre-attached fasteners 50, 60, 70 thereon.

The first pre-attached fastener 50 can be a spring clip fastener 50 that can include an elongated base 51 with one end 52 pre-attached to a midportion of the blade arm 40 by fasteners 53 such as but not limited to screws, and the like, with an upwardly protruding bendable portion 54 having a generally sloped top 55 with gripable (roughened and/or patterned type surface that is not slippery) and an inwardly directed overhanging clip edge 56. The distal end 57 of base 51 can have a through-hole 58 that allows the distal end 57 to move up and down on the shaft 59.S of an enlarged headed fastener 59 that is pre-attached to the top of the blade mounting end 46 of the blade arm 40. The upwardly protruding portion 54 and/or tab base 51 and/or shaft 59.S of the fastener 59 can have grommet surface, such as but not limited to being formed of elastomeric, rubber, plastic, and the like, so as to minimize and/or isolate vibrations from the blade 2 being attached at that location to the blade arm 40.

The second pre-attached fastener 60 can have an enlarged headed fastener 62 such as but not limited to a screw and the like, that has one or more cylindrical washers 64 and a raised enlarged cylindrical base 66, where the cylindrical base 66 can have a larger diameter than the washer(s) 64. The washer(s) 64 and/or base 66 can also have a grommet surface such as but not limited to being formed of elastomeric, rubber, plastic, and the like, so as to minimize and/or isolate vibrations that can occur from the blade 2 being attached at that location to the blade arm 40.

The third pre-attached fastener 70 can have a fastener 72, such as but not limited to a screw, and the like, that holds an outwardly protruding clip ledge 74 over a shaft 76 having outwardly sloping lower sides 77 with an enlarged base 78 that has a larger diameter than the shaft 76. The clip ledge 74 and/or the shaft 76 and/or the enlarged base 78 can also have a grommet surface such as but not limited to being formed of elastomeric, rubber, plastic, and the like, so as to minimize and/or isolate vibrations that can occur from the blade 2 being attached at that location to the blade arm 40.

Figure 3:
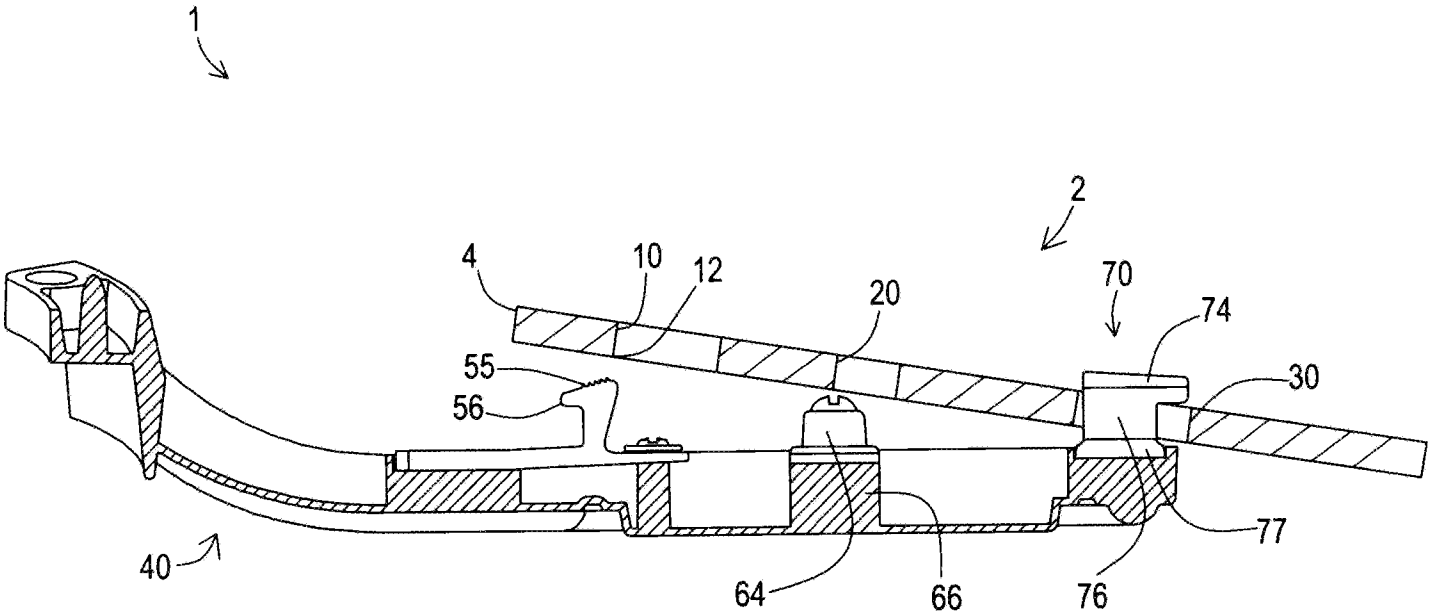
FIG. 3 is a side cross-sectional view of the novel blade about to be installed on the blade arm with the blade in an initial tilted position.
Figure 4:
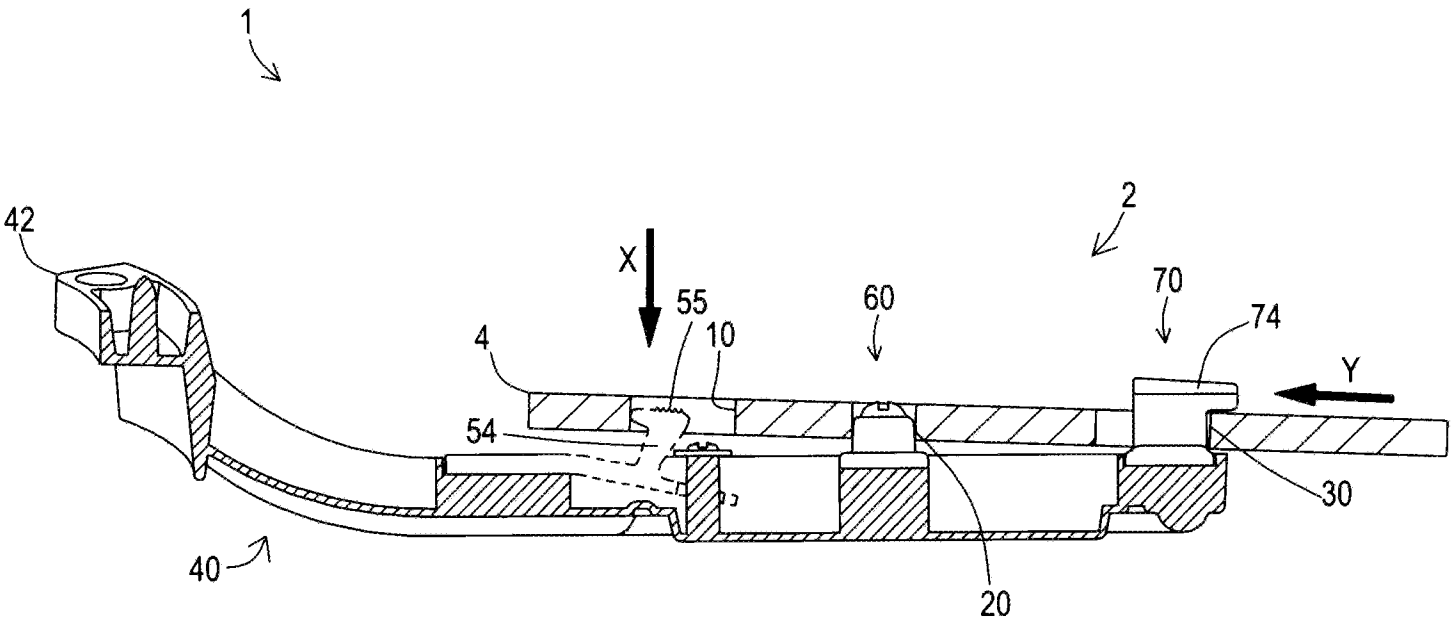
FIG. 4 is another side cross-sectional view of the blade of FIG. 3 being moved inward and starting to be lowered downward to abut against the mounting end of the blade arm as the next step in the installation process.
Figure 5:
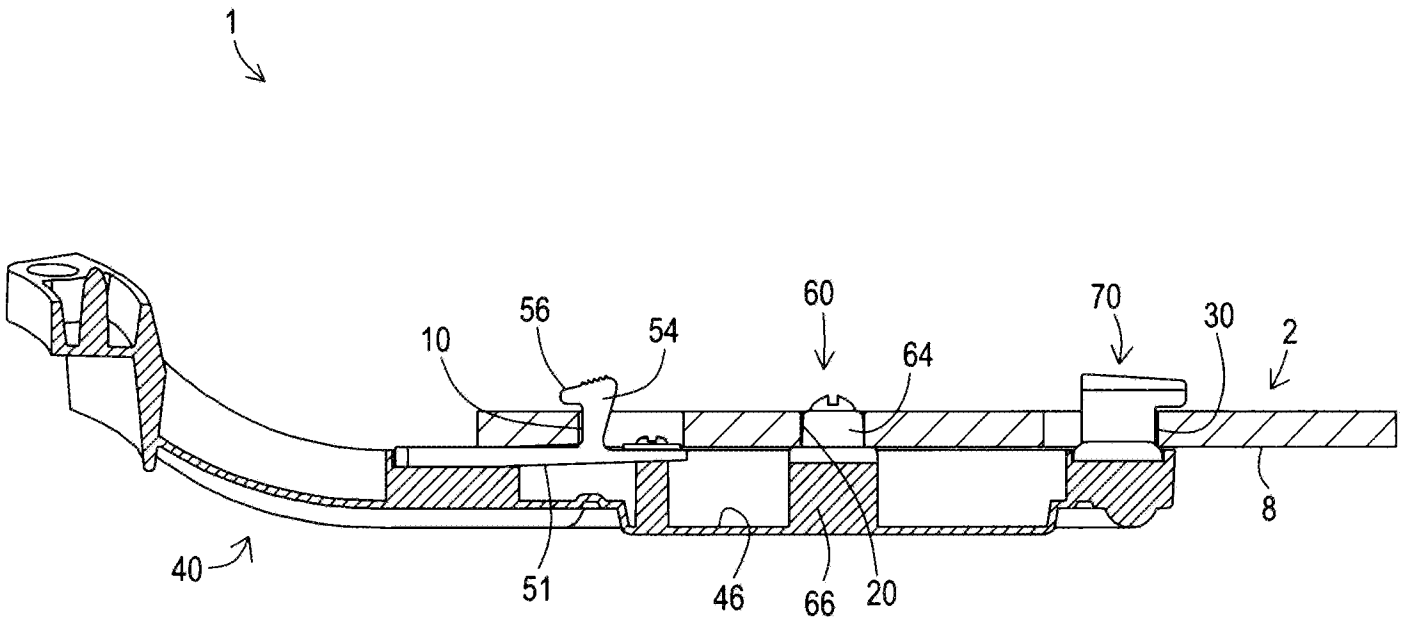
FIG. 5 is another side cross-sectional view of the blade and arm of FIG. 3 in a final installation position.

FIGS. 3, 4 and 5 show the three step attachment process of the three slot attachment embodiment 1.

FIG. 3 is a side cross-sectional view of the novel blade 2 about to be installed on the blade arm 40. The mounting end 4 of the blade 2 can be tilted upward and laid over the top mounting end 46 of the blade arm 40 so that the third slot 30 passes over the top of the clip ledge 74 until the bottom of the slot 30 rests on the outwardly sloping lower sides 77 of the shaft 76. As shown the top of the clip edge 74 is sized slightly larger than the slot 30. As shown in FIG. 4, the rearwardly extending clip edge 74 overhangs the edge of the third slot 30 so that the third fastener 70 clips onto the third slot 30.

Next, the tilted blade 2 is moved in the direction of arrow Y toward the motor attached end 42 of the blade arm 40 as shown in FIGS. 3 and 4. This is followed by the inner end 40 of the blade 4 being moved downward in the direction of arrow X, which causes a front lower edge 12 of the first slot to push down on the sloped top 55 of the upwardly protruding bendable portion 54 causing a midportion of the elongated base 51 to bend down slightly, while the through-hole 58 in the distal end 57 of the elongated base slides downward over the shaft 59.S of the pre-attached fastener 59.

FIG. 5 is another side cross-sectional view of the blade 2 and arm 40 of FIG. 3 in a final installation position. Here the inwardly extending overhanging clip edge 56 clips over a front edge of the first slot 10 with the bottom 8 of the blade 2 resting on the elongated tab base 51. As shown, the cylindrical washer(s) 64 can have a similar diameter to allow the washer(s) 64 to be snugly positioned within the second slot 20 with the bottom 8 of the blade 2 resting on top of the enlarged base 66. The second fastener 60 functions as a mounting post for the second slot 20. In FIG. 5, the third fastener 70 remains clipped to the third slot 30.

For a ceiling fan having multiple blades, each blade can be installed in a similar manner to that shown and described relative to FIGS. 1-5.

Figure 6:
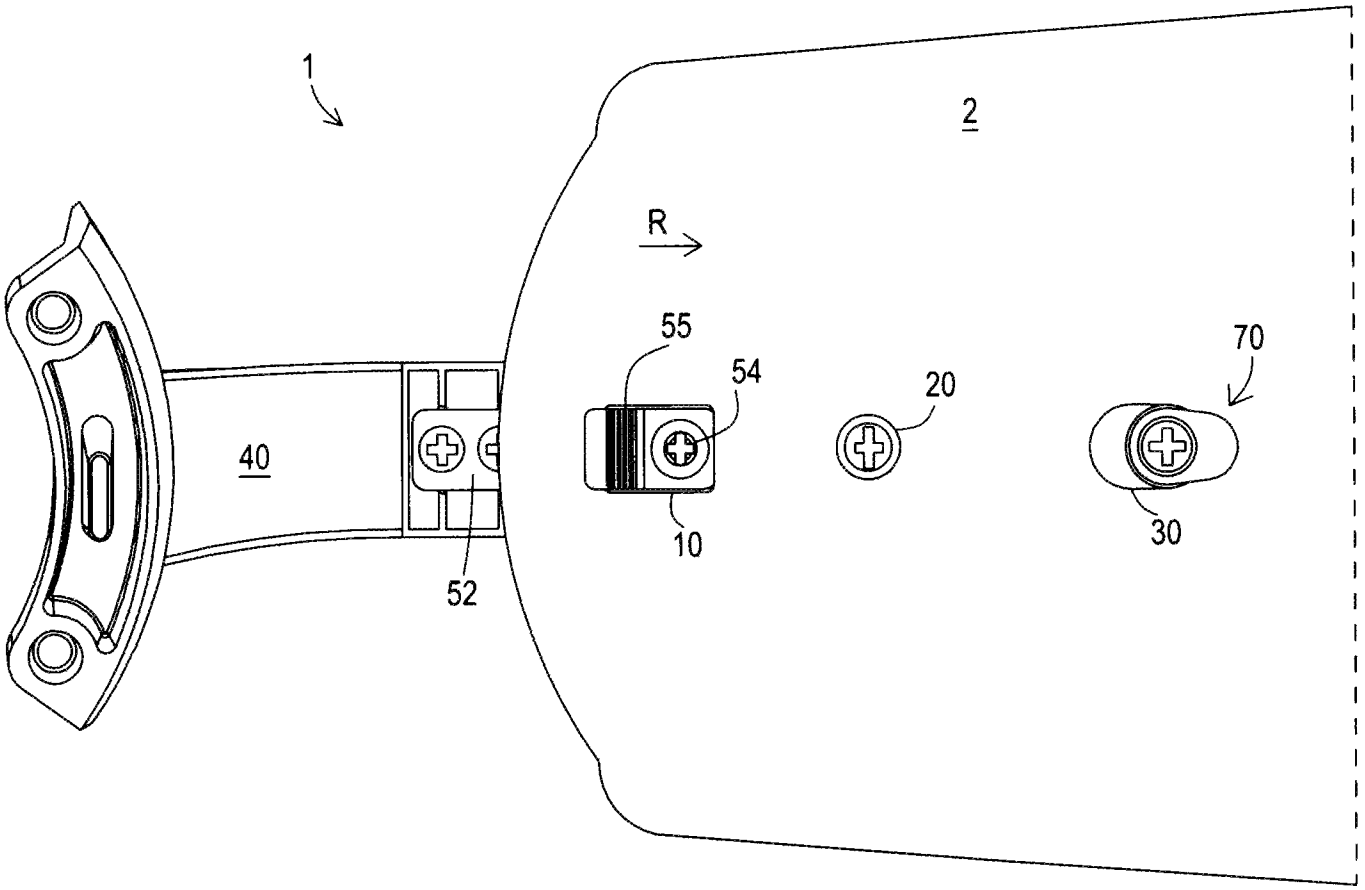
FIG. 6 is a top view of the installed blade and blade arm of FIG. 5.
Figure 7:
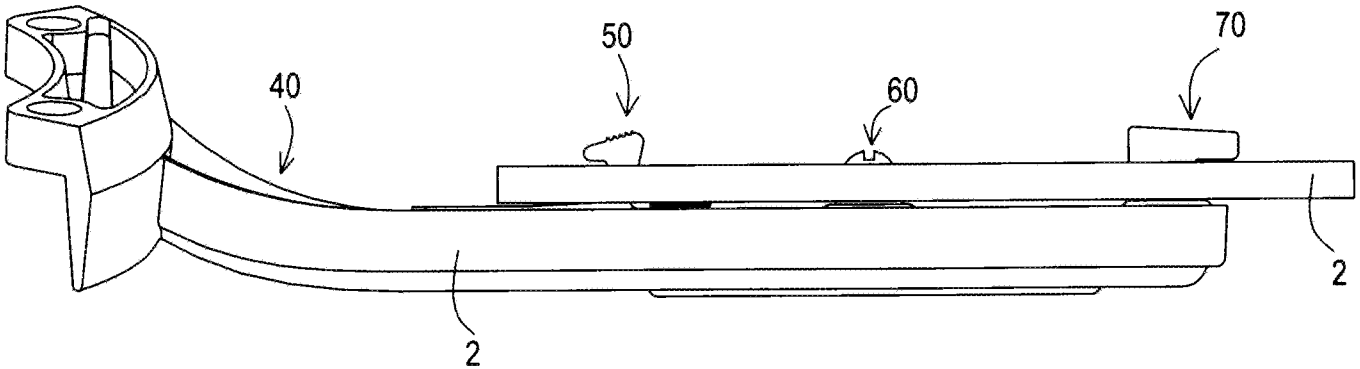
FIG. 7 is a side view of the installed blade and blade arm of FIG. 6.
Figure 8:
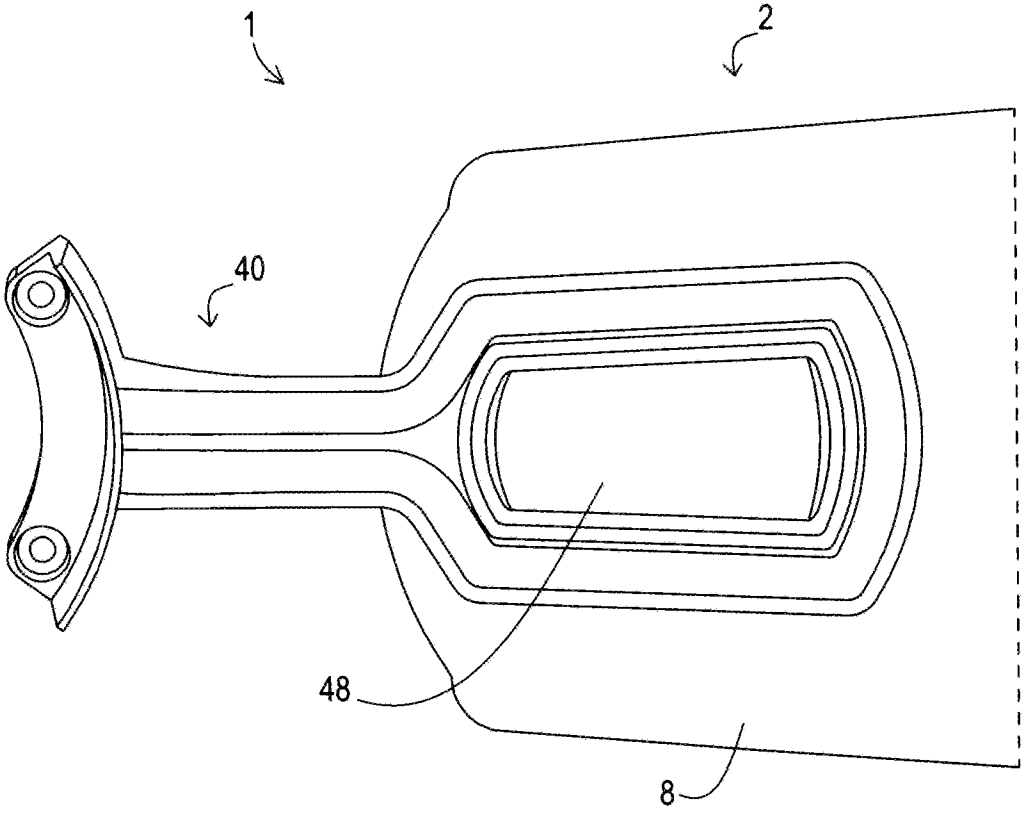
FIG. 8 is a bottom view of the installed blade and blade arm of FIG. 6.
Figure 9:
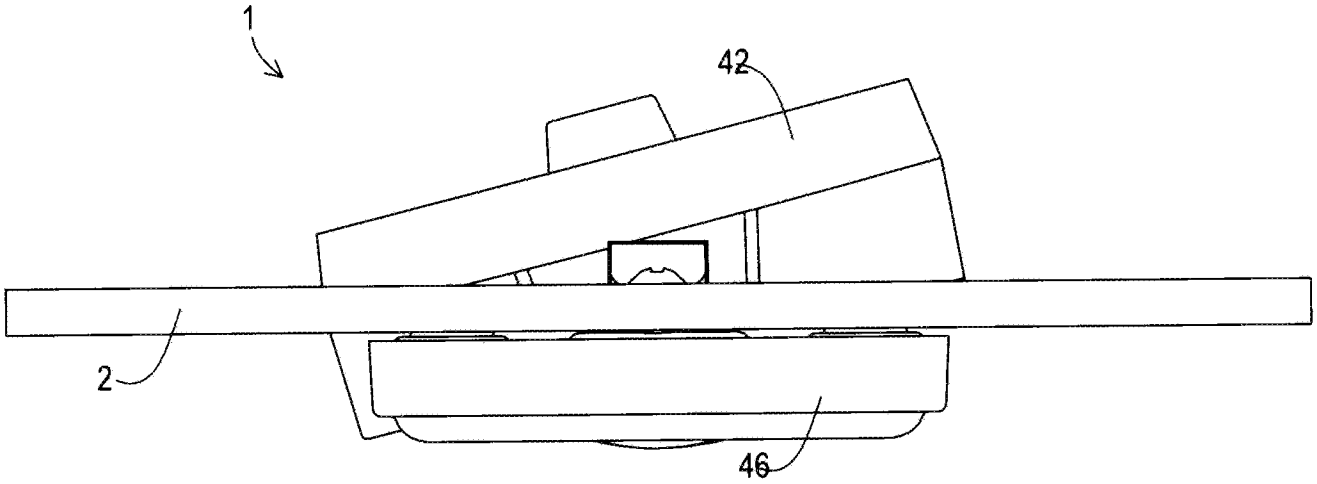
FIG. 9 is an outer blade end view of the installed blade and blade arm of FIG. 6.
Figure 10:
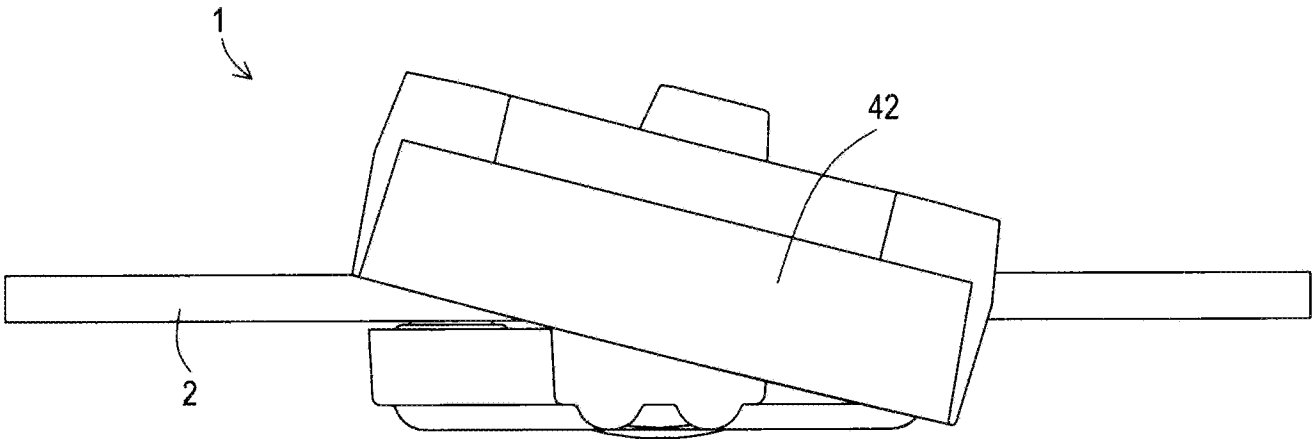
FIG. 10 is a blade arm end view of the installed blade and blade arm of FIG. 6.

FIG. 6 is a top view of the installed blade 2 and blade arm 40 of FIG. 5. FIG. 7 is a side view of the installed blade 2 and blade arm 40 of FIG. 6. FIG. 8 is a bottom view of the installed blade 2 and blade arm 40 of FIG. 6. FIG. 9 is an outer blade end view of the installed blade 2 and blade arm 40 of FIG. 6. FIG. 10 is a blade arm end 42 view of the installed blade 2 and blade arm 40 of FIG. 6.

The blade 2 can be removed by having the installer push their finger or fingers on the gripping surface 55 of the upwardly protruding portion and pushing the first fastener backward in the direction of arrow R as shown in FIG. 6. Next, the steps shown and described in relation to FIGS. 3, 4, and 5 are reversed until the blade 2 is removed from the blade arm 40. All the blades in a ceiling fan can be removed in a similar manner.

Four Slot Attachment

Figure 11:
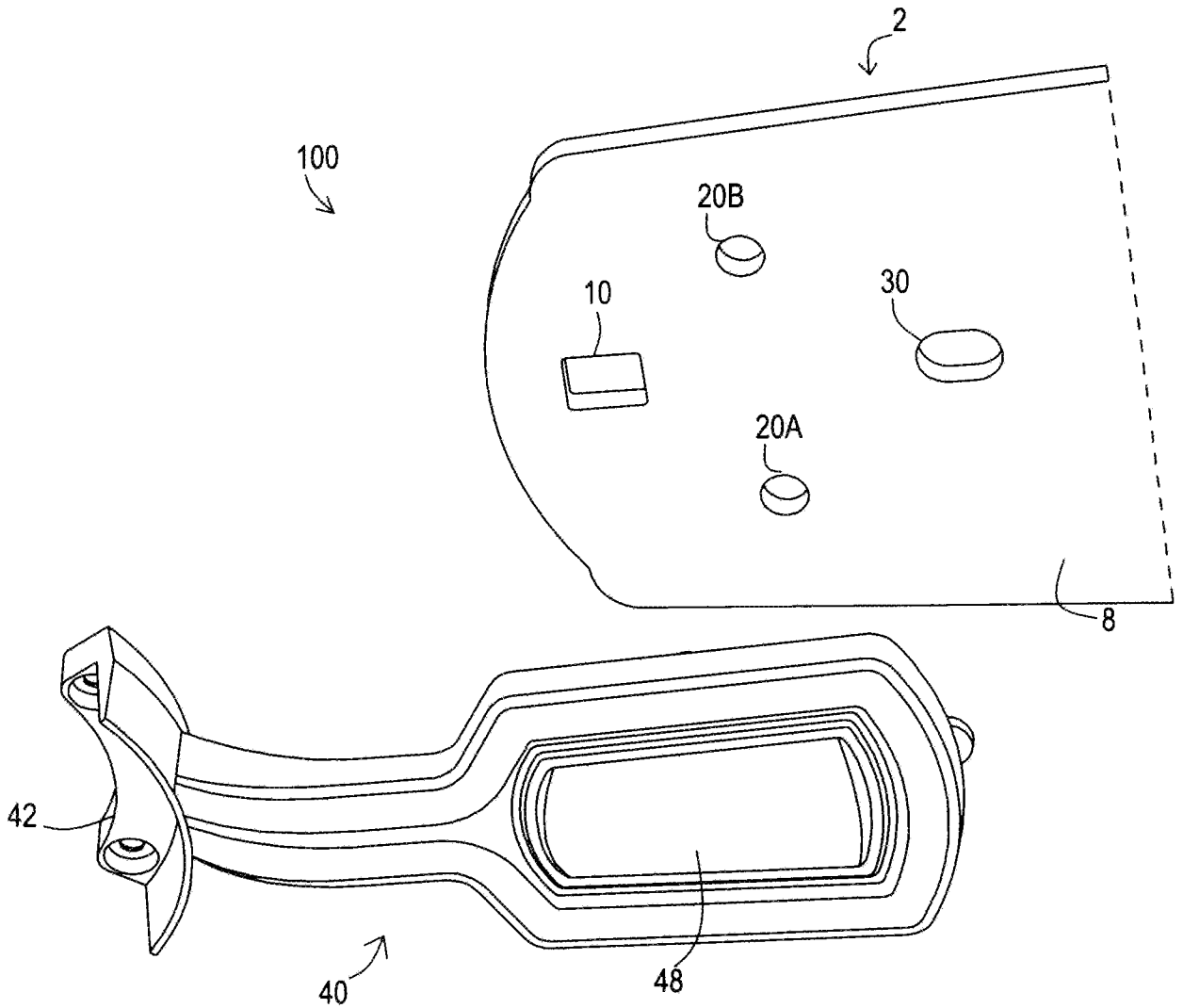
FIG. 11 is a bottom perspective view of a second embodiment of the quick installation ceiling fan blade spaced apart from a ceiling fan blade arm.
Figure 12:
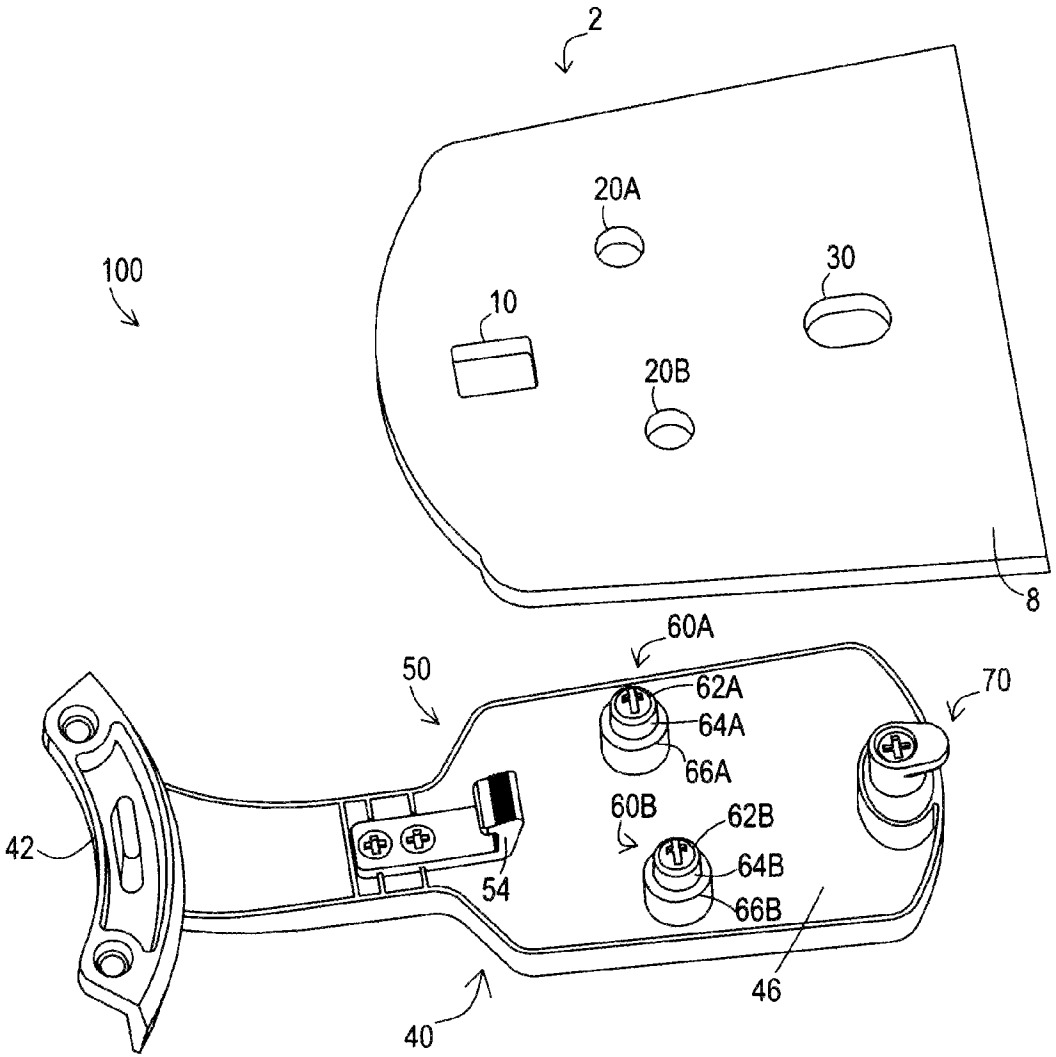
FIG. 12 is a top perspective view of the ceiling fan blade and blade arm of FIG. 11.

FIG. 11 is a bottom perspective view of a second embodiment 100 of the quick installation ceiling fan blade 2 spaced apart from a ceiling fan blade arm 40. FIG. 12 is a top perspective view of the ceiling fan blade 2 and blade arm 40 of FIG. 11.

The four slot embodiment can be similar to the first three slot embodiment, with the difference being there are two central slots 20A and 20B between the first slot 10 and the third slot 30. And there are two central posts 60A and 60B that are similar to the central pre-attached fastener 60 previously described.

The first central pre-attached fastener 60A can have an enlarged headed fastener 62A such as but not limited to a screw and the like, that has one or more cylindrical washers 64A and a raised enlarged cylindrical base 66A, where the cylindrical base 66A can have a larger diameter than the washer(s) 64A. The washer(s) 64A and/or base 66A can also have a grommet surface such as but not limited to being formed of elastomeric, rubber, plastic, and the like, so as to minimize and/or isolate vibrations that can occur from the blade 2 being attached at that location to the blade arm 40.

The second central pre-attached fastener 60B can have an enlarged headed fastener 62B such as but not limited to a screw and the like, that has one or more cylindrical washers 64B and a raised enlarged cylindrical base 66B, where the cylindrical base 66B can have a larger diameter than the washer(s) 64B. The washer(s) 64B and/or base 66B can also have a grommet surface such as but not limited to being formed of elastomeric, rubber, plastic, and the like, so as to minimize and/or isolate vibrations that can occur from the blade 2 being attached at that location to the blade arm 40.

The steps for installing the blade 2 of the second embodiment 100 onto the blade arm 40 of the second embodiment can be done similar to that described in the first embodiment 1. During installation, both central slots 20A and 20B are lined up to pass over the upwardly protruding pre-attached fasteners 60A and 60B.

Figure 13:
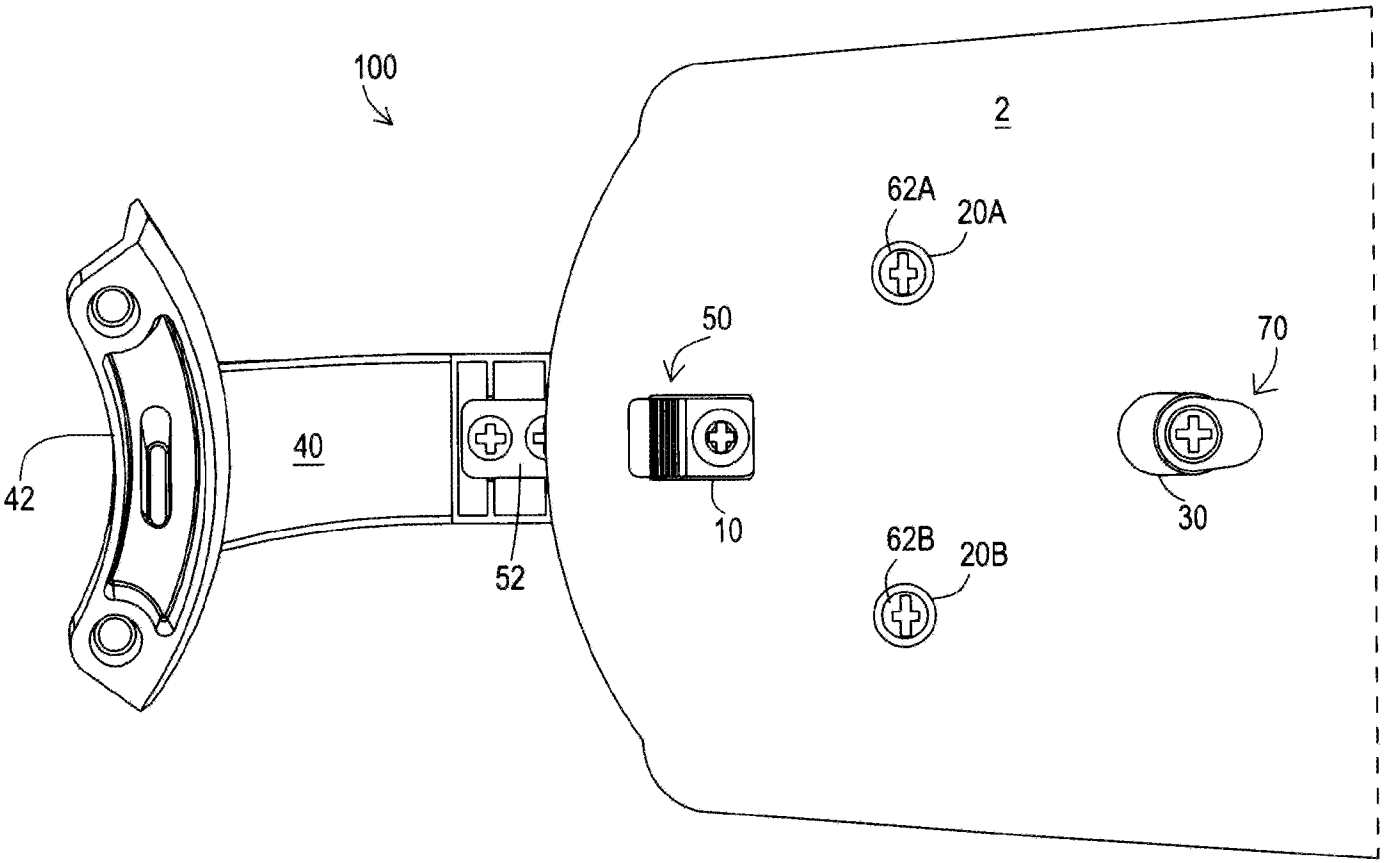
FIG. 13 is a top view of the installed blade and blade arm of FIGS. 11-12.
Figure 14:
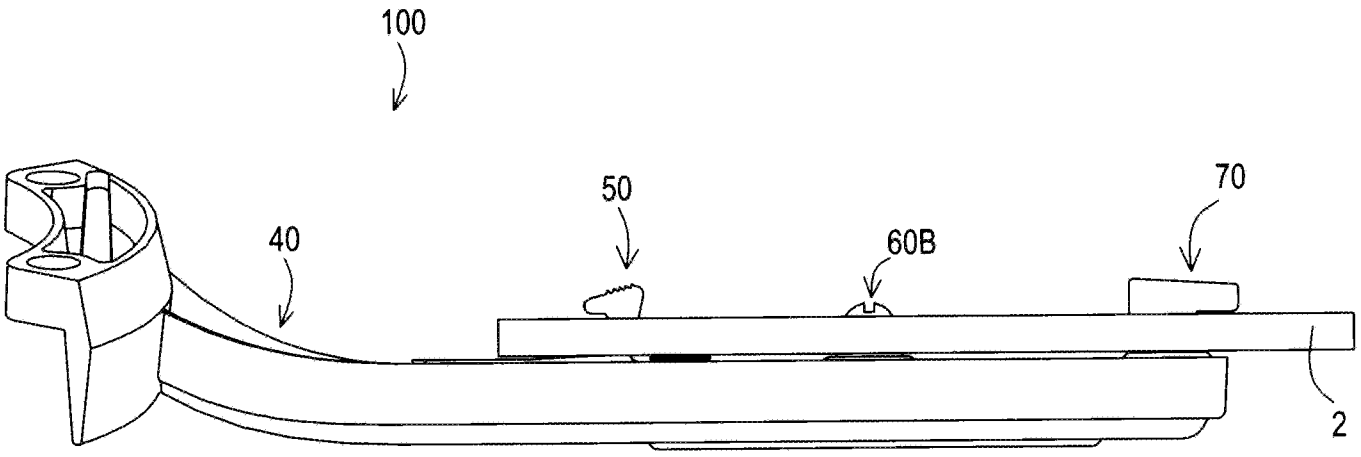
FIG. 14 is a side view of the installed blade and blade arm of FIG. 13.
Figure 15:
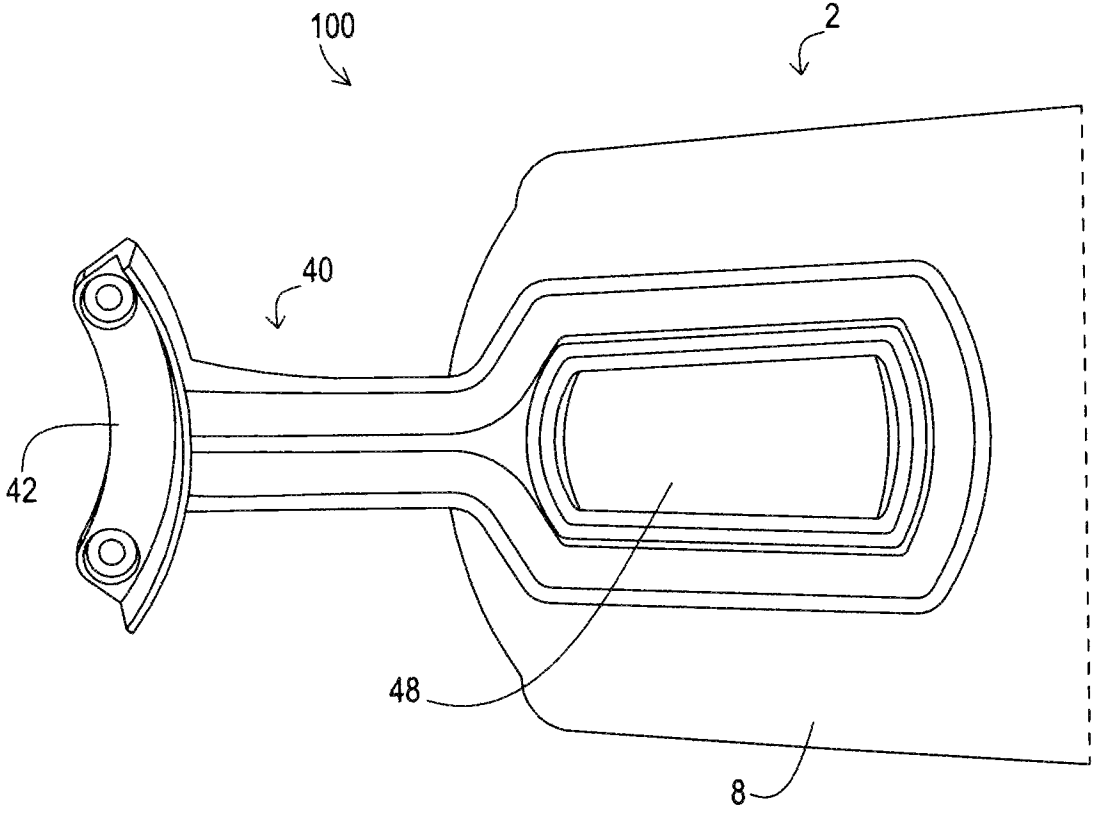
FIG. 15 is a bottom view of the installed blade and blade arm of FIG. 13.
Figure 16:
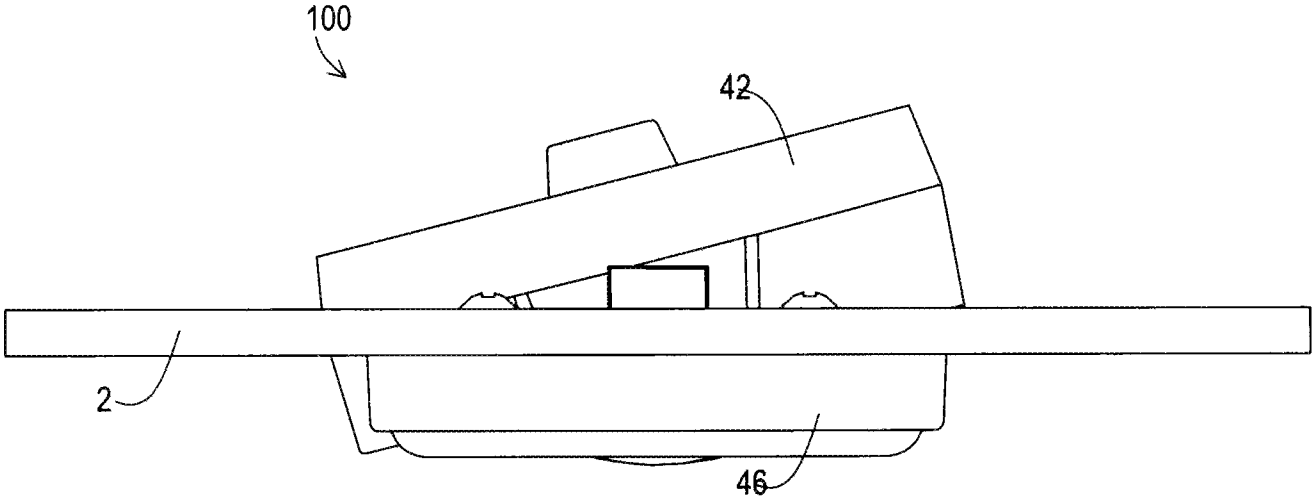
FIG. 16 is an outer blade end view of the installed blade and blade arm of FIG. 13.
Figure 17:
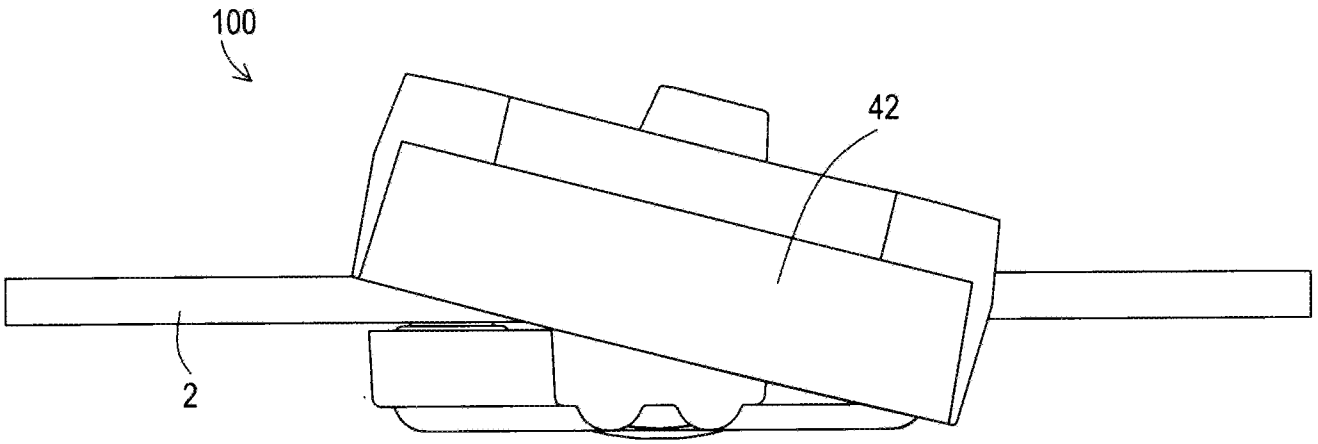
FIG. 17 is a blade arm end view of the installed blade and blade arm of FIG. 13.

FIG. 13 is a top view of the installed blade 2 and blade arm 40 of FIGS. 11-12. FIG. 14 is a side view of the installed blade 2 and blade arm 40 of FIG. 13. FIG. 15 is a bottom view of the installed blade 2 and blade arm 40 of FIG. 13. FIG. 16 is an outer blade end view of the installed blade 2 and blade arm 40 of FIG. 13. FIG. 17 is a blade arm end 42 view of the installed blade 2 and blade arm 40 of FIG. 13.

Figure 18:
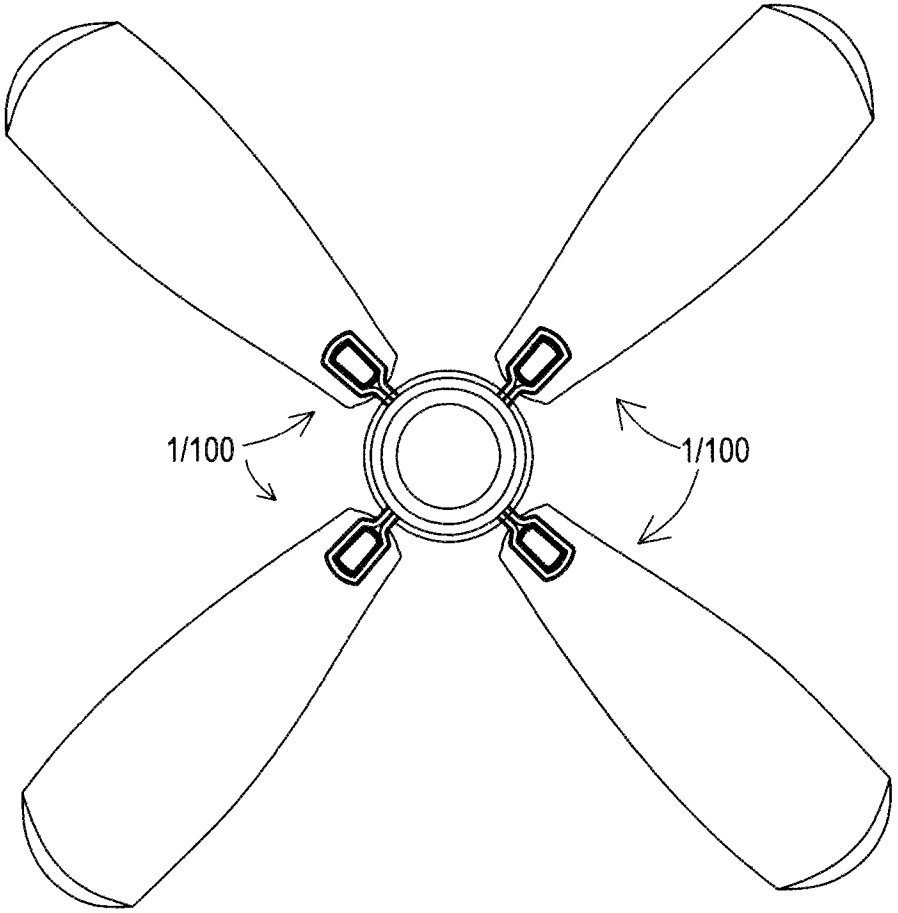
FIG. 18 shows a bottom view of a ceiling fan using the multiple installed blade and blade arms used in the invention.

FIG. 18 shows a bottom view of a ceiling fan using the multiple installed blade and blade arms 1/100 used in the invention.

While the springably bendable pre-attached fastener has clip edge facing inward toward the motor mounting end of the blade arm, the clip edge can be faced in a different direction such as but not limited to one side, both sides, toward the outer end of the blade, and the like. While the outer pre-attached fastener is shown with a outer lip edge rearwardly facing out to the outer end of the blade, the outer lip edge can be faced in a different direction such as but not limited to one side, both sides, toward the outer end of the blade, and the like.

Although the slots are shown with shapes such as rectangular, circular and oval, the slots can other types of geometrical shapes and other types of combinations of geometrical shapes that still allow for the quick installation of the blades to the fan.

While the three slot embodiment shows the slots in a generally straight line, the slots can be other shapes such as but not limited to triangular, and/or off-axis to one another. While the slots are shown generally in a straight line down the center of the blade, the slots can be arranged in other directions, such as but not limited to being across the blade from one side to another.

While the four slot embodiment shows the slots in a trapezoidal pattern, the slots can be arranged in other patterns such as but not limited to a straight line, a triangular shape, a rectangular shape, and the like.

Although the embodiments show the quick installation fasteners located on the distal (adjacent the motor) end of the blade arm, these fasteners can be located on the blade with their respective attachment slots located on the blade arm. Additionally, the quick installation fasteners can be located on the motor mount with the slots on the inner (motor mounting) end of the blade arm. Alternatively, the fasteners can be on the inner end of the blade arm, with the respective slots adjacent to the underside of the motor.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A quick installation ceiling fan comprising:

a ceiling fan motor;

a plurality of blades each of the blades having a first slot adjacent to a root end of the blade, a second slot adjacent to a tip end of the blade, and at least one middle slot between the first slot and the second slot; and a plurality of blade arms, each of the blade arms having a proximate end attached to the ceiling fan motor and a distal end, the distal end of each blade arm having a first fastener with a hook edge extending in a first direction, at least one upwardly extending post for fitting into the at least one middle slot in the blades, and a second fastener having a hook edge facing in a second direction which is different from the first direction, with one of the first and the second fasteners being bendable, wherein the blades are mounted to the blade arms by overlaying one of the first slot or the second slot of each blade over one of the first fastener and the second fastener of each blade arm, and positioning the at least one middle slot over the at least one post and hooking one of the first fastener with the hook edge or the second fastener with the hook edge to snap onto another one of the first slot or the second slot.

2. The quick installation ceiling fan of claim 1, wherein the at least one upwardly extending post includes:

a single cylindrical post, wherein the first fastener and the single post and the second fastener are positioned in a single straight line on each mounting arm.

3. The quick installation ceiling fan of claim 1, wherein one of the first fastener and the second fastener includes:

an enlarged head with a sloped surface on top of a shaft wherein pushing down on the sloped top allows the fastener to bend downward until the enlarged head passes through one of the first slot and the second slot and snaps back in place locking the moveable bendable head portion to the one of the first slot and the second slot.

4. The quick installation ceiling fan of claim 1, wherein one of the first fastener and the second fastener includes:

an inwardly directed overhanging clip edge directed toward the ceiling fan motor.

5. The quick installation ceiling fan of claim 1, wherein one of the first fastener and the second fastener includes an enlarged head with a gripable surface.

6. The quick installation ceiling fan of claim 1, wherein each blade arm includes:

at least one grommet adjacent to the slots for reducing vibration and undesirable noise from the blades being attached to the blade arms.

7. The quick installation ceiling fan of claim 1, further comprising:

a second middle slot between the first slot and the second slot.

8. The quick installation ceiling fan of claim 7, wherein the at least one upwardly extending post includes:

two posts for the two middle slots, wherein the two middle slots are not in a straight line between the first slot and the second slot.

9. The quick installation ceiling fan of claim 8, wherein one of the first fastener and the second fastener includes:

an inwardly directed overhanging clip edge directed toward the ceiling fan motor.

10. The quick installation ceiling fan of claim 7, wherein one of the fasteners includes:

an enlarged head with a sloped upper surface on a shaft wherein pushing down on the sloped top allows the fastener to bend downward until the enlarged head passes through one of the first slot and the second slot and snaps back in place locking the enlarged head to the one of the first slot and the second slot.

11. A method of installing ceiling fan blades on a ceiling fan comprising the steps of:

providing a plurality of blades each having mounting ends with a first slot located adjacent to a root end of the blade, a second slot adjacent to a tip end of the blade, and a middle slot between the first slot and the second slot;

providing a plurality of ceiling fan blade arms each having motor mounting ends attached to a motor and blade mounting ends with a first upwardly protruding fastener adjacent to the motor mounting ends having a hook edge facing in a first direction, and a second upwardly protruding fastener spaced away from the first fastener having a hook edge facing in a second direction which is different from the first direction, and at least one middle post, with one of the first and second fasteners being bendable;

angling the blades to the blade mounting ends of the blade arms so that the hook edge on one of the first and the second fasteners passes through one of the first and the second slots;

laying down the blades over the at least one middle post while bending the bendable fastener; and locking the blades to the blade arms when the bendable fastener is bent back in place into one of the first and the second slots.

12. The method of claim 11, wherein the first fastener, the middle post and the second fastener are positioned in a straight line on each blade arm.

13. The method of claim 11, further comprising:

a second middle post on each blade arm, wherein the middle post is not in a straight line with the first fastener and the second fastener.

14. The method of claim 11, wherein the first hook edge and the second hook edge are in opposite facing directions.

15. A quick installation ceiling fan comprising in combination:

a plurality of blades each of the blades having a first slot adjacent to a motor end of each blade, a second slot spaced toward a tip end of each blade and a middle slot adjacent between the first slot and the second slot; and a plurality of blade arms, each of the blade arms having a proximate end attached to a ceiling fan motor and a distal end, each blade arm having first fastener and a second fastener, and a middle post therebetween, with the first fastener located closer to the ceiling fan motor than the second fastener, the first fastener and the second fastener having hook edges, with one of the hook edges having a springably moveable head portion, the head portion being moveable up and down, wherein the blades are mounted to the blade arms by overlaying the slots over the fasteners, so that one of the hook edges clips onto one of the first slot and the second slot, and the moveable head portion of one of the first fastener and the second fastener snaps into another one of the first slot and the second slot.

16. The quick installation ceiling fan of claim 15, further comprising:

a second middle slot adjacent to the first middle slot, and the middle post includes two upwardly protruding middle posts adjacent to one another.

17. The quick installation ceiling fan of claim 15, wherein the middle slot is in a straight line with the first slot and the second slot.

18. The quick installation ceiling fan of claim 15, wherein the hook edges are in opposite facing directions.

19. A quick installation ceiling fan comprising in combination:

a plurality of blades each of the blades having a root end with a plurality of slots; and a plurality of blade arms, each of the blade arms having a proximate end attached to a ceiling fan motor and a distal end, each distal end having first fastener and a second fastener and at least one post therebetween, with the first fastener located closer to the ceiling fan motor than the second fastener, the first fastener and the second fastener having hook edges which face in different directions from one another, with one of the hook edges having a bendable head portion, wherein the blades are mounted to the blade arms by overlaying the slots over the fasteners and the at least one post, so that one of the hook edges clips onto one of the first slot and the second slot, and the bendable head portion of another one of the first fastener and the second fastener snaps into another one of the first slot and the second slot.

20. The quick installation ceiling fan of claim 19, wherein the hook edge on the first fastener and the hook edge on the second fastener are facing in opposite directions from one another.

* * * * *